US008408831B2

(12) United States Patent
Paradise et al.

(10) Patent No.: US 8,408,831 B2
(45) Date of Patent: Apr. 2, 2013

(54) WRITING INSTRUMENT CASING AND METHODS OF USE

(76) Inventors: Peter A. Paradise, Lakewood, CO (US); James R. Paradise, Lakewood, CO (US)

( * ) Notice: Subject to any disclaimer, the term of this patent is extended or adjusted under 35 U.S.C. 154(b) by 778 days.

(21) Appl. No.: 12/533,897

(22) Filed: Jul. 31, 2009

(65) Prior Publication Data

US 2011/0027000 A1 Feb. 3, 2011

(51) Int. Cl.
*B43K 23/00* (2006.01)

(52) U.S. Cl. ..... 401/48; 401/88; 401/98; 401/131

(58) Field of Classification Search ..... 401/6, 88, 401/98, 107, 109, 48, 131
See application file for complete search history.

(56) References Cited

U.S. PATENT DOCUMENTS

| | | | | |
|---|---|---|---|---|
| 2,362,582 | A * | 11/1944 | Pearson | 401/54 |
| 2,398,583 | A | 4/1946 | Feather | |
| 2,655,131 | A | 10/1953 | Wendt | |
| 2,759,453 | A | 8/1956 | Baun | |
| 2,808,670 | A | 10/1957 | Katz | |
| 3,740,159 | A | 6/1973 | Smagala-Romanoff | |
| 3,767,035 | A | 10/1973 | Koelichen | |
| 4,595,307 | A | 6/1986 | Heyden | |
| 4,896,983 | A | 1/1990 | Im et al. | |
| 5,062,727 | A | 11/1991 | Kageyama et al. | |
| 5,505,553 | A | 4/1996 | Saviano et al. | |
| 5,722,782 | A | 3/1998 | Rosenthal | |
| 5,772,345 | A * | 6/1998 | Simonds | 401/48 |
| 5,951,183 | A * | 9/1999 | Landis | 401/48 |
| 5,971,644 | A * | 10/1999 | Kageyama et al. | 401/99 |
| 6,276,854 | B1 | 8/2001 | Mullins | |
| 6,454,479 | B1 * | 9/2002 | Lychwick | 401/92 |
| 6,485,211 | B1 * | 11/2002 | Leo et al. | 401/6 |
| 6,488,426 | B1 * | 12/2002 | Perry et al. | 401/6 |
| 6,547,470 | B2 * | 4/2003 | Legg | 401/195 |
| 6,551,002 | B1 | 4/2003 | Puglisi | |
| 6,568,866 | B1 * | 5/2003 | Hsu | 401/6 |
| 6,942,408 | B2 | 9/2005 | Smith | |
| 6,997,314 | B2 | 2/2006 | Torkelson | |
| 7,063,475 | B2 * | 6/2006 | Kirita et al. | 401/222 |
| 7,232,270 | B1 * | 6/2007 | Goldstein | 401/93 |
| 7,883,754 | B2 * | 2/2011 | Qiu et al. | 428/35.7 |
| 2006/0029460 | A1 * | 2/2006 | Russo | 401/247 |
| 2009/0169285 | A1 * | 7/2009 | Cabatan | 401/109 |
| 2010/0150639 | A1 * | 6/2010 | Ryan et al. | 401/104 |
| 2011/0038659 | A1 * | 2/2011 | Andochick | 401/48 |
| 2011/0103874 | A1 * | 5/2011 | Reekie et al. | 401/88 |

FOREIGN PATENT DOCUMENTS

DE 695398 8/1953

OTHER PUBLICATIONS

Budynas, Richard G. and Nisbett, J. Keith; Shigley's Mechanical Engineering Design; 2008; McGraw Hill; Eigth Edition; p. 540.*

* cited by examiner

*Primary Examiner* — David Walczak
*Assistant Examiner* — Bradley Oliver
(74) *Attorney, Agent, or Firm* — Holland & Hart LLP

(57) ABSTRACT

Various systems and methods are provided for adorning various writing instruments. A casing removably receives the writing instrument such that at least the writing tip extends outwardly from a grip portion of the casing. A cap is provided for removably engaging the grip portion to fully enclose the writing instrument. An opening from which the writing tip is disposed is sized to accommodate various writing instruments. A biasing member within the barrel of the casing is provided to accommodate writing instruments of various lengths. An intercap seal within the cap of the casing enables an original cap to the writing instrument to not be used for protecting the writing tip and preventing the writing instrument from drying out.

17 Claims, 4 Drawing Sheets

WRITING INSTRUMENT CASING AND METHODS OF USE

BACKGROUND

Fine writing pens of various styles are sold and used throughout the world. Such writing instruments typically require the use of ink cartridges that are used within the writing instrument until the ink within the cartridge is substantially depleted. The user must then disassemble the pen and replace the ink cartridge with a refill. However, such refills can be very difficult to obtain. In particular, most fine writing instruments require the use of very specific and uniquely shaped refill cartridges. Accordingly, one must obtain the refill cartridges from specialized stores or search for a supplier that may be based half a world away.

The difficulty in using such fine writing instruments extends beyond the inconvenience of locating ink cartridge refills. Such specialized cartridges can be quite expensive. For example, the average price for a typical refill cartridge for fine writing instruments is approximately $5.00. This is certainly a significant cost when one considers that most disposable pens of various styles cost less than $1.00. Accordingly, over the useful life of a fine writing instrument, its user may be bothered with the inconvenience and high cost of continually maintaining the writing medium within the instrument.

Clearly an alternative to the expense and inconvenience of maintaining fine writing instruments is to use disposable writing instruments that are readily available throughout the world at very affordable prices. However, the appearance of such disposable writing instruments can be less than desirable. Certainly little status or novelty is gained through the use of a disposable pen that may cost 25 cents when sold in a bulk pack from a local convenience store. Accordingly, what is needed is a system and method for adorning disposable pens in a manner that may reduce the need for continually using and maintaining fine writing instruments. Unfortunately, most disposable pens are provided in a wide array of shapes and sizes from their lengths to their widths. Therefore, one would need a specialized casing to specifically fit each type of disposable pen to be adorned.

SUMMARY

This Summary is provided to introduce a selection of concepts in a simplified form that are further described below in the Detailed Description. This Summary, and the foregoing Background, is not intended to identify key aspects or essential aspects of the subject matter. Moreover, this Summary is not intended for use as an aid in determining the scope of the subject matter.

A system for adorning disposable writing instruments is provided herein. In at least some embodiments, the system is provided for adorning writing instruments of a disposable variety that have a writing tip of various forms at one end that is placed in communication with a writing medium disposed within a vessel that is housed within a casing of the writing instrument. It is contemplated that the writing instrument could be of various different styles, including: felt-tip, rollerball, ballpoint, and the like. It is further contemplated that the writing instrument may be designed to use one of various different forms of writing media, such as various types of ink, that are known and used within the industry.

In at least one embodiment, the system is provided in the form of a casing that may be itself decorated in various colors, patterns, and in a wide array of materials. In at least one embodiment, the casing includes a barrel having an open first end portion and an opposite second end portion. The open first end portion of the barrel is associated with an open interior. A grip portion may also be provided as a part of the casing. The grip may be formed separately or in uniform construction with the barrel. The grip will be provided with an open first end portion and an open second end portion, which is associated with the open first end portion of the barrel. The casing may further include a cap having an open first end portion and an opposite second end portion. The first end portion of the cap will be selectively, removably securable with the grip.

In at least one method of use, the writing instrument is substantially disposed within the interior portion of the barrel and the grip portion and positioned so that at least a portion of the writing tip extends outwardly from the open first end portion of the grip.

In at least one embodiment, an intercap seal, having an open first end portion and an opposite second end portion, may be disposed within the intercap of the casing. In particular, the intercap seal may be positioned to at least partially receive the writing tip of the writing instrument within an opening at the first end portion of the intercap seal when the cap is secured with the grip portion of the casing. In this position, a peripheral edge portion of the first end portion of the intercap seal will engage a portion of the writing instrument in order to provide a sealed enclosure of the writing tip of the writing instrument.

In some embodiments, a resiliently deformable biasing member is disposed within the second end portion of the barrel of the casing. The biasing member is positioned to bias the writing instrument toward the open first end portion of the grip when the writing instrument is disposed within the barrel and grip of the casing.

These and other aspects of the present system will be apparent after consideration of the Detailed Description and Figures herein. It is to be understood, however, that the scope of the invention shall be determined by the claims as issued and not by whether given subject matter addresses any or all issues noted in the Background or includes any features or aspects recited in this Summary.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

Figure 1:
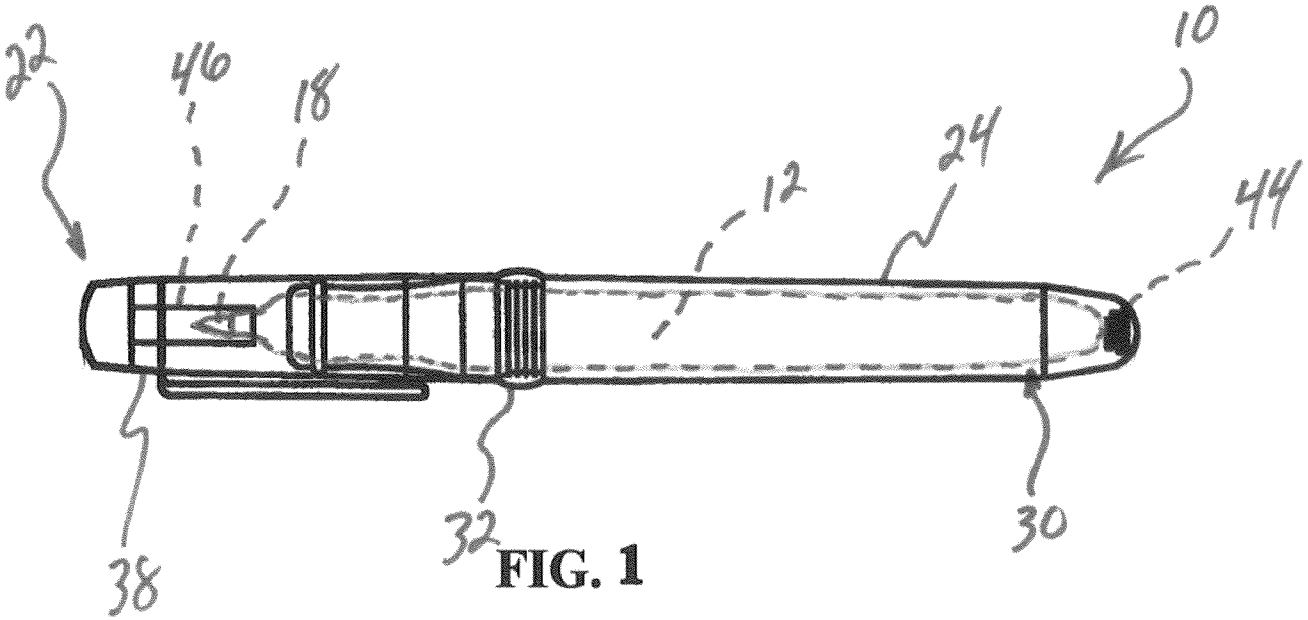
FIG. 1 is a partially cut-away side view of one embodiment of a system for adorning writing instruments.
Figure 2:
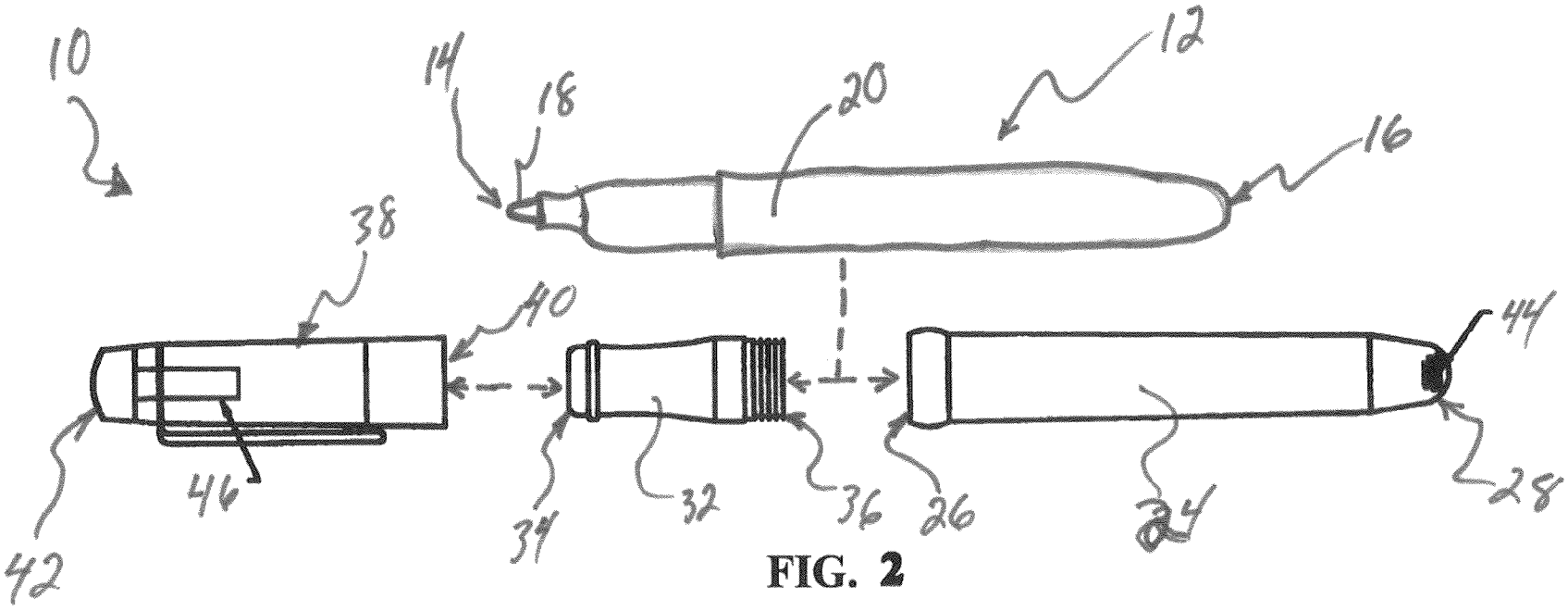
FIG. 2 is a partially exploded side view of an embodiment of a system for adorning writing instruments.
Figure 3:
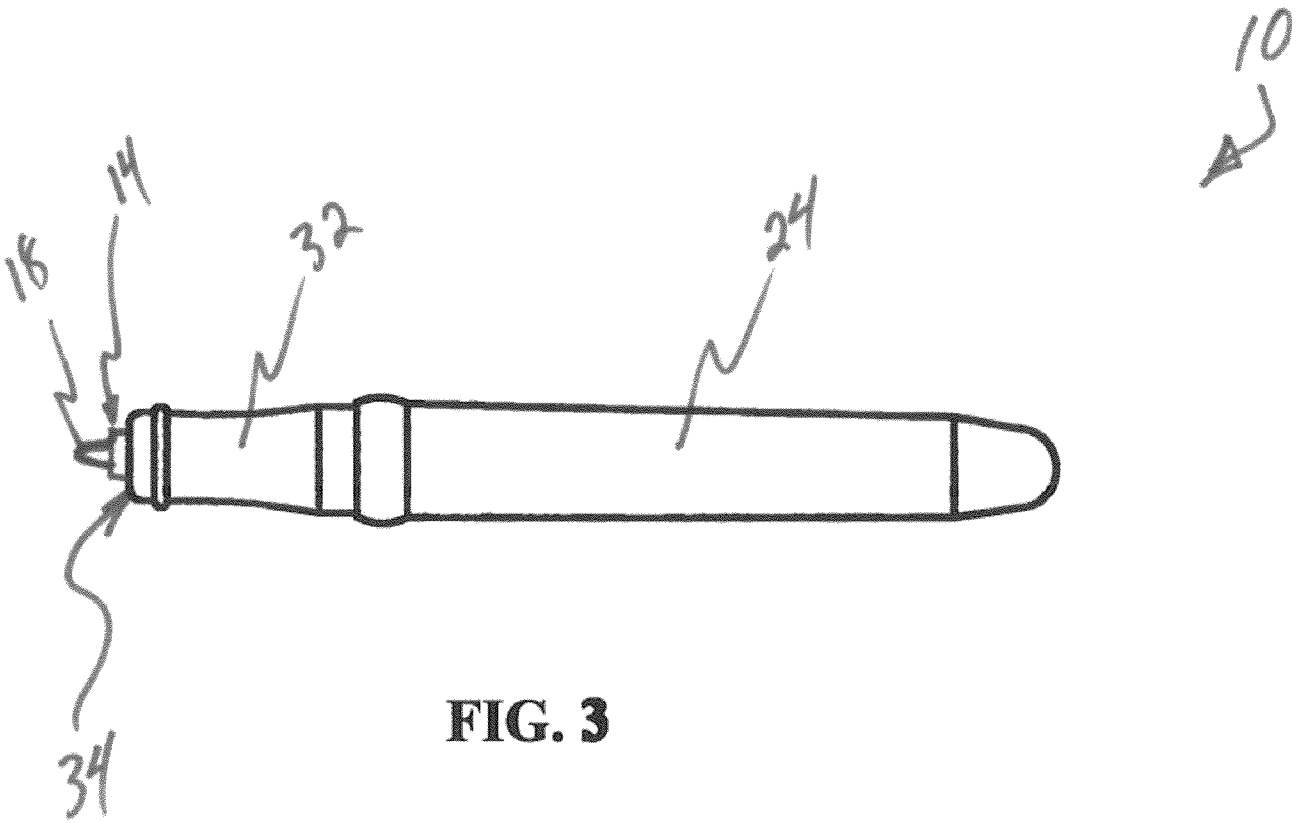
FIG. 3 is a side view of one embodiment of a partially assembled system for adorning writing instruments.
Figure 4:
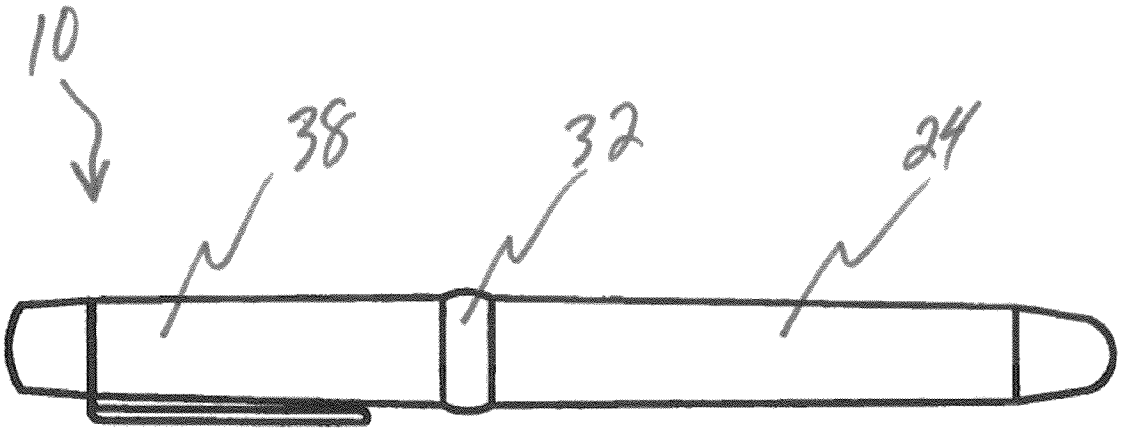
FIG. 4 is a side view of one embodiment of a fully assembled system for adorning writing instruments.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

Various embodiments of a system 10 are provided for adorning various different types and sizes of writing instruments 12. It is contemplated that the writing instruments 12 will include a first end portion 14 and an opposite second end portion 16, with a writing tip 18 being disposed at the first end portion 14. It is further contemplated that the writing tip 18 may be provided in various forms. For example, the writing tip 18 may be a felt-tip, rollerball, ballpoint, or other such known writing tip. A writing medium, such as inks of various types, colors, viscosities and compositions, will be stored within a vessel, such as an elongated plastic tube, that has one open end associated with the writing tip 18 in a manner that permits the writing medium to be communicated freely with the writing tip 18. A casing 20 will be provided to enclose the vessel and position the writing tip 18 so that the writing medium may be selectively disposed on various surfaces by the user. The system 10 will generally include a casing 22. The casing 22 will include a barrel 24 that is formed to have an open first end portion 26 and an opposite second end portion 28. The open first end portion 26 of the barrel will be associated with an open interior portion 30 that extends substantially the length of the barrel 24. A grip 32 will be provided with an open first end portion 34 and an opposite, open second end portion 36. The second end portion 36 will be associated with the first end portion 26 of the barrel 24. In some embodiments, the barrel 24 and the grip portion 32 may be formed to be of unitary construction. In such instances, however, the need for which will become apparent herein, the second end portion 28 of the barrel 24 may be provided to be selectively opened and closed. However, in many embodiments, the barrel 24 and the grip portion 32 may be provided as to separate structures that may be releasably coupled with one another. It is contemplated that the coupling between the first end portion 26 of the barrel 24 and the second end portion 36 of the grip 32 may be provided with mating threads or other mechanical structures to enable a secure but releasable fit between the two.

The casing 22 will further be provided with a cap 38 having an open first end portion 40 and an opposite second end portion 42. In at least some embodiments, the first end portion of the cap 38 will be selectively, removably securable with the grip portion 32. It is contemplated that the releasable engagement between the grip portion 32 and the cap 38 may be provided in the form of mating threads or other mechanically engaging structures. It is further contemplated that the structures may simply press-fit with one another to provide a frictional engagement.

The open interior 30 of the barrel 24 and an interior of the grip portion 32 will typically be sized and shaped to accommodate a substantial portion of the writing instrument 12. In particular, the writing instrument should be able to be selectively disposed within the interior portion 30 of the barrel 24 and the grip portion 32 so that at least a portion of the writing tip 18 extends outwardly from the open first end portion of the grip portion 32. In this position, the second end portion 16 of the writing instrument 12 may be placed in contact with the second end portion 28 of the barrel 24. In this manner, the related structures may be sized such that little, if any, longitudinal movement of the writing instrument 12 will be permitted between the second end portion 28 of the barrel 24 and the open first end portion 34 of the grip portion 32.

It is contemplated that the system 10 will be used with writing instruments 12 of various lengths and widths. Accordingly, in at least some embodiments, a resiliently deformable biasing member 44 is disposed within the second end portion 28 of the barrel 24. The biasing member 44 will be positioned to bias the writing instrument 12 toward the open first end portion 34 of the grip portion 32 when the writing instrument is disposed within the barrel 24 and grip portion 32. It is contemplated that various materials and structures may be used to provide the biasing member 44. In at least one embodiment, the biasing member is a coiled spring, having a generally conical shape along its length. While it is contemplated that coiled springs will provide a long, useful life, the conical shape of the spring may limit deflection of the spring laterally as it is compressed along its long axis. Accordingly, less incidence of error in engaging the writing instrument 12 and biasing it in a generally forward direction toward the grip portion 32 will be attained. However, it is contemplated that other embodiments of the system 10 may use a biasing member 44 that is provided in the form of a different material and structure, such as a resilient foam, rubber, and the like. Irrespective of the type of biasing member 44 used, some embodiments will provide approximately 2-10 millimeters of adjustment to fit different lengths of writing instruments 12. Such a degree of adjustability may be sufficient where the barrel 24 and grip portion 32 are constructed to have a combined exterior length (in an assembled position) of approximately 5.25 inches to 5.75 inches. In at least one embodiment, the barrel 24 and the grip portion 32 are provided to have a combined, assembled length of approximately 4.56 inches.

To further accommodate writing instruments 12 of various sizes, the open first end portion 34 of the grip end portion 32 is sized, in many embodiments, to be approximately 0.125 inches to 0.375 inches in diameter. In at least one embodiment, the open first end portion 34 is provided to be approximately 0.25 inches in diameter. In this size range, a sufficient amount of the writing tip 18 is exposed through the open first end portion 34 of the grip portion 32 while engaging a portion of the writing instrument 12 adjacent the writing tip 18. Generally speaking, the opening of the first end portion 34 should be provided with a smaller diameter than a greatest diameter of the writing instrument 12, whereby the writing instrument will not completely pass through the open first end portion 34 of the grip portion 32.

The aforedescribed embodiments of the system 10, and in particular the size and configuration of the barrel 24 and grip portion 32, have been proven to successfully accommodate at least the following commercially available writing instruments:

Sharpie fine point marker
Sharpie Liquid Accent highlighter
Uni-ball rollerball
Uni-ball Deluxe rollerball
Uni-ball Vision rollerball
Uni-ball Vision Elite rollerball
Uni-ball Signo Bit needle point rollerball
Pilot P-700 needle point rollerball
Pilot P-500 needle point rollerball
Pilot V-Ball Grip rollerball
Pilot V-Razor felt tip
Papermate Liquid Espresso porous tip
Papermate Liquid Flair felt tip
Staedler Liquid Point rollerball
Foray Liquid Porous felt tip
Foray Liquid rollerball
Preppy Platinum fountain pen However, it is contemplated that a much larger list of commercially available writing instruments 12 will fit with within the aforedescribed configuration in dimensions. Accordingly, the above described list is provided for exemplary purposes only and should not be construed as limiting in any fashion.

Most writing instruments 12 of a disposable nature are provided with a cap that will protect the writing tip 18 and greatly increasing the time required to dry out the writing medium used within the writing instruments 12. However, where the system 10 is provided with a cap 38, the original cap for the writing instrument 12 may be left unused. In such embodiments, the system may be provided with an intercap seal 46, having an open first end portion 48 and an opposite second end portion 50. The second end portion 50 of the intercap seal 46 may be secured within the cap 38, adjacent the second end portion 42. In particular, the intercap seal 46 may be positioned to at least partially receive the writing tip 18 of the writing instrument 12 within the open first end portion 48 of the intercap seal 46, and engage a peripheral edge of the open first end portion 48 with a portion of the writing instrument 12, when the cap 38 is secured with the grip portion 32. In this manner, the writing tip 18 of the writing instrument 12 is protected from external forces and further the writing medium within the writing instrument 12 will be provided with a longer useful life as the writing tip 18 will be prevented from drying out. While the intercap seal 46 may be provided in various shapes and from various materials, a cylindrical or a conical shape will generally accommodate the writing tip 18 and first end portion 14 of most writing instruments 12. Moreover, various plastics and other slightly forgiving materials may be used to create a greater sealing engagement between the intercap seal 46 and the writing instrument 12. However, other materials, such as brass and other metals, are contemplated.

The system 10 may provide the casing 22 in a variety of external shapes, colors and configurations to accommodate the decorative desires of the user. In this manner, a wide variety of materials, inlays, decorative coverings and the like may be applied. This may further be considered when the overall weight of the system 10 and its feel are being determined. Accordingly, various metals, plastics, glass, and the like may be used to form the various components of the system 10 to provide for its look, feel, weight and durability. Moreover, the shape may be accommodated for various ergonomic rationale as well as design.

Although the system has been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth). Expressions such as "up," "down,", "upper," "lower," "horizontal," "vertical," "left," "right," and the like are used, where applicable, to provide some clarity of description when dealing with relative relationships but these terms are not intended to imply absolute relationships, positions, and/or orientations. For example, with respect to an object, an "upper" surface can become a "lower" surface simply by turning the object over. Nevertheless, it is still the same object.

What is claimed is:

1. In combination:

a writing instrument having opposite first and second end portions; the first end portion including a writing tip; a writing medium disposed within a replacement vessel and associated with the writing tip; and a writing instrument casing that substantially encloses the replacement vessel; and an exterior casing, the exterior casing including:

a barrel having an open first end portion and an opposite second end portion; the open first end portion being associated with an open interior portion;

a grip portion having an open first end portion and an open second end portion; the second end portion being associated with the open first end portion of the barrel; and a cap having an open first end portion and an opposite second end portion; the first end portion of the cap being selectively, removably securable with the grip;

the writing instrument being substantially disposed within the interior portion of the barrel and the grip portion and positioned so that at least a portion of the writing tip extends outwardly from the open first end portion of the grip portion.

2. The combination of claim 1 further comprising:

an intercap seal, having an open first end portion and an opposite second end portion; the second end portion of the intercap seal being secured within the cap, adjacent the second end portion of the cap, and positioned to at least partially dispose the writing tip of the writing instrument within the open first end portion of the intercap seal, and engage a peripheral edge of the open first end portion of the intercap seal with a portion of the writing instrument, when the cap is secured with the grip.

3. The combination of claim 1 further comprising:

a resiliently deformable biasing member disposed within the second end portion of the barrel and positioned to bias the writing instrument toward the open first end portion of the grip when the writing instrument is disposed within the barrel and the grip.

4. The combination of claim 3 wherein the biasing member is a spring.

5. The combination of claim 4 wherein the spring is a coil spring having generally a conical shape along a length of the spring.

6. The combination of claim 3 further comprising:

an intercap seal, having an open first end portion and an opposite second end portion; the second end portion of the intercap seal being secured within the cap, adjacent the second end portion of the cap, and positioned to at least partially dispose the writing tip of the writing instrument within the open first end portion of the intercap seal, and engage a peripheral edge of the open first end portion of the intercap seal with a portion of the writing instrument, when the cap is secured with the grip.

7. The combination of claim 1 wherein the first end portion of the barrel is selectively, removably securable with the open second end portion of the grip.

8. The combination of claim 1 wherein the writing instrument is a disposable writing instrument.

9. The combination of claim 8 wherein the writing instrument is a felt-tip pen.

10. The combination of claim 8 wherein the writing instrument is a ballpoint pen.

11. The combination of claim 8 wherein the writing instrument is a rollerball pen.

12. The combination of claim 1 wherein the opening in the first end portion of the grip is approximately 0.125 inch to 0.375 inch in diameter.

13. The combination of claim 1 wherein the opening of the first end portion of the grip has a smaller diameter than a greatest diameter of the writing instrument, whereby the writing instrument may not completely pass through the open first end portion of the grip.

14. The combination of claim 1 wherein the barrel and grip portion have a combined length of approximately 5.25 inches to 5.75 inches.

15. A method of adorning a writing instrument, the method comprising:

providing a writing instrument having opposite first and second end portions; the first end portion including a writing tip; a writing medium disposed within a replacement vessel and associated with the writing tip; a writing instrument casing that substantially encloses the replacement vessel; and a writing instrument cap having an open first end portion and an opposite second end portion; the first end portion of the writing instrument cap being selectively, removably securable with the writing instrument casing; and providing an exterior casing, the exterior casing including:

a barrel having an open first end portion and an opposite second end portion; the open first end portion being associated with an open interior portion;

a grip portion having an open first end portion and an open second end portion; the second end portion being associated with the open first end portion of the barrel; and a cap having an open first end portion and an opposite second end portion; the first end portion of the cap being selectively, removably securable with the grip;

separating the writing instrument cap from the writing instrument casing;

substantially disposing the writing instrument within the interior portion of the barrel and the grip portion so that at least a portion of the writing tip extends outwardly from the open first end portion of the grip portion.

16. The method of claim 15 further comprising:

biasing the writing instrument toward the open first end portion of the grip portion with a resiliently deformable biasing member that is disposed within the second end portion of the barrel.

17. The method of claim 16 further comprising:

providing an intercap seal, having an open first end portion and an opposite second end portion, within the cap; the second end portion of the intercap seal being secured within the cap, adjacent the second end portion of the cap;

securing the cap with the grip portion, whereby the writing tip of the writing instrument is at least partially disposed within the open first end portion of the intercap seal and a peripheral edge of the open first end portion of the intercap seal engages a portion of the writing instrument.

* * * * *